US006598786B1

(12) United States Patent
Guo

(10) Patent No.: US 6,598,786 B1
(45) Date of Patent: Jul. 29, 2003

(54) MELIORATION OF INSULATING PAPER CONTAINER

(76) Inventor: Tzer-Huang Guo, No. 57, Li Jing 1st St., Chidu Chiu, Keelung City (TW)

( * ) Notice: Subject to any disclaimer, the term of this patent is extended or adjusted under 35 U.S.C. 154(b) by 0 days.

(21) Appl. No.: 10/087,840

(22) Filed: Mar. 5, 2002

(51) Int. Cl.[7] ..... B65D 3/22
(52) U.S. Cl. ..... 229/403; 220/592.25; 220/902
(58) Field of Search ..... 229/4.5, 400, 403; 220/592.17, 592.2, 592.25, 739, 902

(56) References Cited

U.S. PATENT DOCUMENTS 3,456,860 A * 7/1969 Janninck ..... 229/400
3,666,162 A * 5/1972 Tiffin et al. ..... 229/400
3,984,511 A * 10/1976 Lammers ..... 229/400
4,261,501 A * 4/1981 Watkins et al. ..... 220/592.17
5,628,453 A * 5/1997 MacLaughlin ..... 229/403
5,752,653 A * 5/1998 Razzaghi ..... 229/403
6,193,098 B1 * 2/2001 Mochizuki et al. ..... 229/403
6,308,883 B1 * 10/2001 Schmeltzer et al. ..... 229/400
6,416,829 B2 * 7/2002 Breining et al. ..... 229/400

* cited by examiner

*Primary Examiner*—Gary E. Elkins
(74) *Attorney, Agent, or Firm*—Bacon & Thomas

(57) ABSTRACT

Insulating paper container including an inner paper cup and an outer paper cup. The inner cup includes a base and double bulge rings and the inner side of outer cup is coated evenly with chemical laminating agent and foaming agent. Space between the two bulge rings allows foaming when the inner cup is placed within the outer cup. The two bulge rings stabilize the structure of the outer cup hence to form a complete insulating paper container unit, and provide a foam insulating layer between the inner and outer cups by heat activating the chemical laminating agent and foaming agent. Therefore the present invention offers a safe and insulated insulating paper container.

4 Claims, 3 Drawing Sheets

MELIORATION OF INSULATING PAPER CONTAINER

BACKGROUND OF THE INVENTION

The present invention is related to melioration of an insulating paper container including an inner paper cup and an outer paper cup. The inner cup includes a base and double bulge rings, whereas the inner side of outer cup is coated with a foamable coating such as polyethylene which includes a chemical laminating agent and foaming agent. Space between the two bulge rings allows foaming when inner cup is assembled within the outer cup.

A conventional paper container is in the shape of a cup or bowl and is usually made by one single layer of paper without any extra processing. Although the manufacturing cost is low, the material used is only a single layer paper, and hence doesn't have the insulation effect. A conventional paper container is not safe enough as it is usually too hot when it contains high temperature liquid.

Accordingly, such type of paper container is unsafe. Although there are several types of high quality paper containers which are coated with wax coating or LDPE coating over the outer surface, these types of paper containers usually are associated with the following defects. Firstly, manufacturing machineries are rather expensive and therefor require a high capital investment. The required machineries such as paraffin wax, polyethylene spreading machine and infrared heating device are usually expensive and require a very high investment capital. They are not generally advised for general public or private use. Since the manufacturing costs are high, the selling price of such containers made by the above expensive machineries will be much higher in comparison to others, and hence will not provide an economic option to chose from in the investment plan. Secondly, the quality of printing on the surface of the container will be poor. Such manufacturing process is related to spreading of foamable material all over the surface of the container. The prints, logo or picture will usually be defaced due to foaming of foamable material on the surface because the foam surface of the container irregular.

Accordingly, it is therefore the primary objective of the present invention to provide the above melioration of insulating paper container, by providing a insulating layer space produced by heating a foamable material which contains chemical laminating agent and foaming agent, wherein such design will lower the possibility of harmful scalding from the hot liquid in the container.

The second objective of the present invention is to provide the above melioration of insulating paper container, which allows vision fantasy and beauty by showing the present objects' beauty and unique style. Coating a chemical laminating agent and a foaming material on the surface of the inner cup will not affect the prints, logo and picture of on the surface of the outer cup after the foam has been produced. Hence the original color and shape of printing, logo and picture of the paper container will be unaltered.

Moreover, the present invention offers an economic and low cost of melioration on insulating paper container. Only two cups are processed, the inner cup and outer cup. When the inner side of outer cup is coated evenly with chemical lamination agent and foaming agent, space between the two bulge rings allows foaming when the inner cup is placed within the outer cup after the chemical laminating agent and foaming agent is heated. The invention only requires an easy manufacture process and simplifies the manufacturing process of the cup base. The partial spreading or coating of the chemical laminating agent and foaming agent permits a time and cost saving when manufacturing large quantities (approximately 130~180 unit/minute).

The present invention can be best understood through the following description and accompanying drawings wherein:

DETAILED DESCRIPTION OF THE PREFERRED EMBODIMENTS

Figure 1:
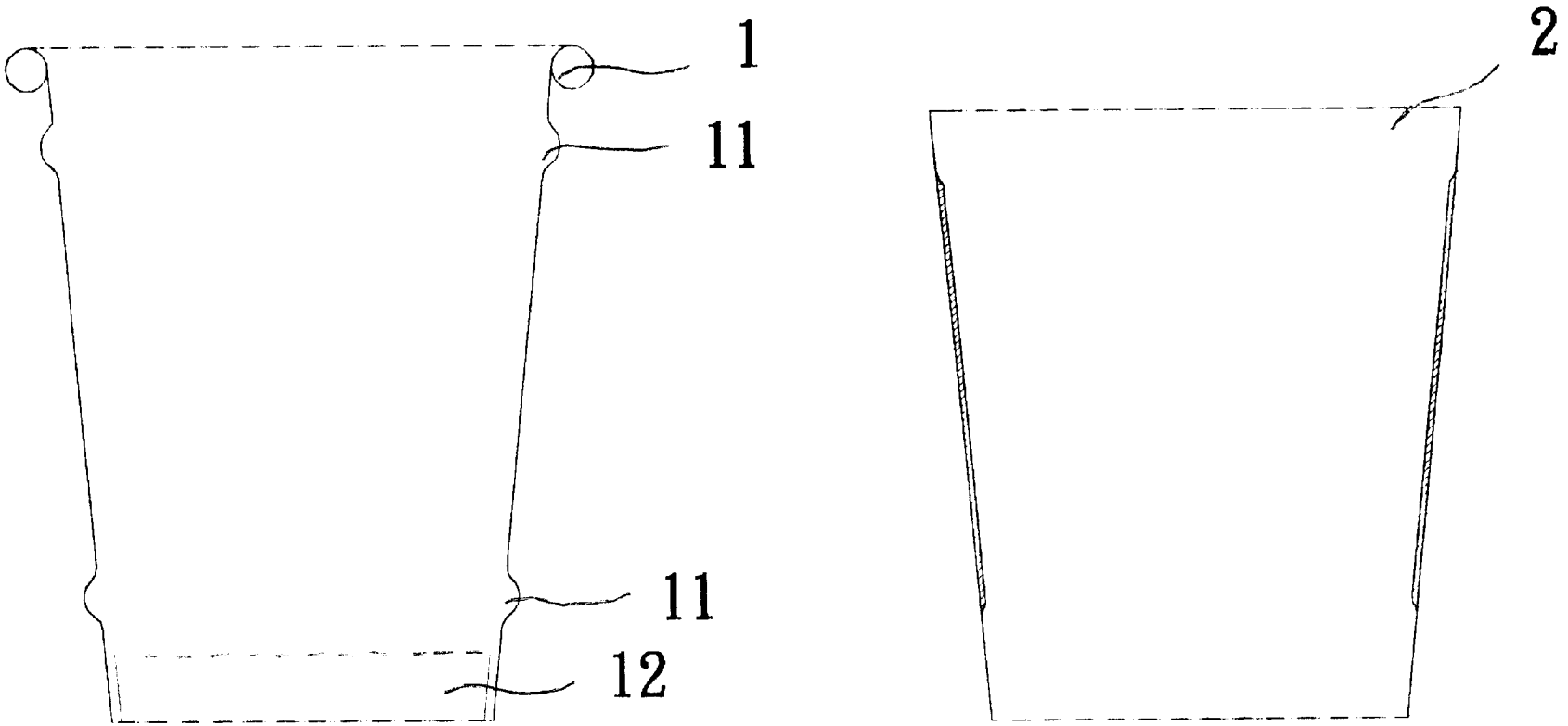
FIG. 1 shows an embodiment of the present invention.

The present invention is related to melioration of an insulating paper container including inner paper cup and outer paper cup. FIG. 1 shows an embodiment of the present invention. The cup unit (4) is assembled by the inner cup(1) and outer cup (3). The inner side of outer cup (3) is coated by spreading evenly with chemical laminating agent and foamable material (2) for example polyethylene. Space between the two bulge rings allows foaming when the inner cup is assembled within the outer cup. The melioration obtained by the insulating paper container of the present invention is due to inward foaming when the chemical laminating agent and foaming material are heated (refer to FIG. 2 and FIG. 3).

SUMMARY OF THE INVENTION

Figure 2:
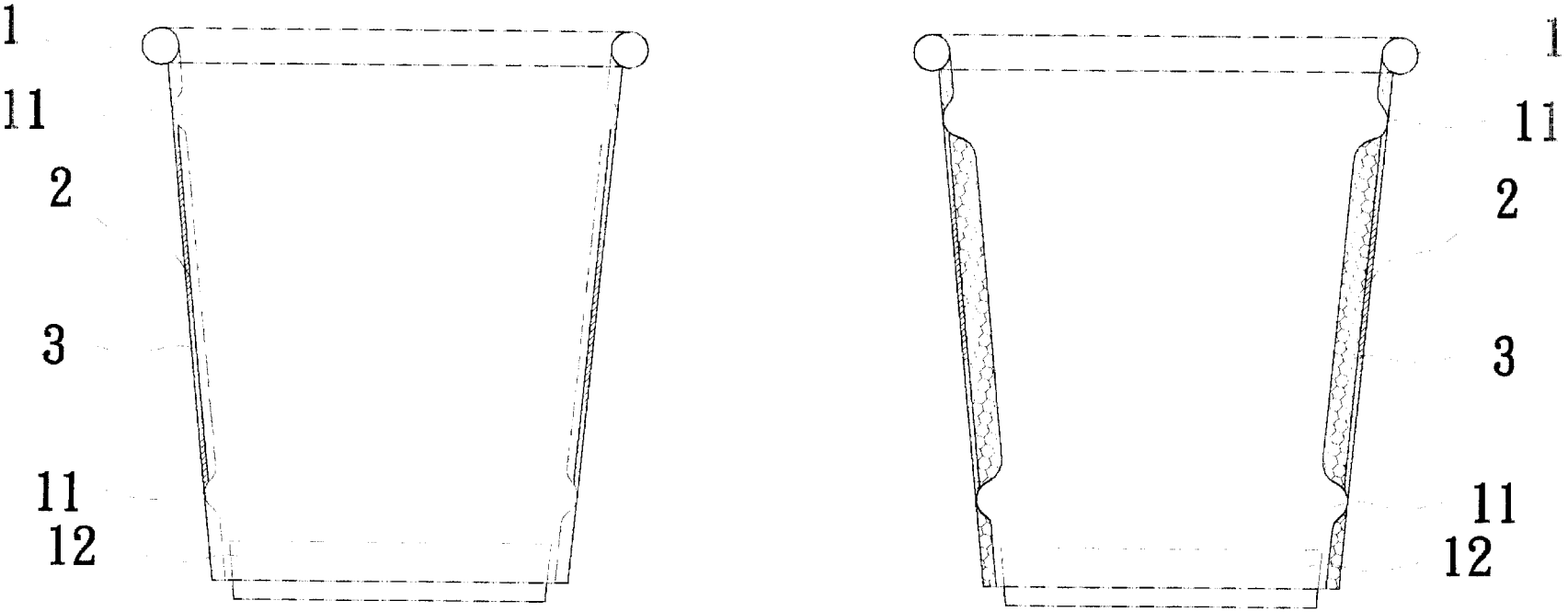
FIG. 2 is a perspective view of the present invention.
Figure 3:
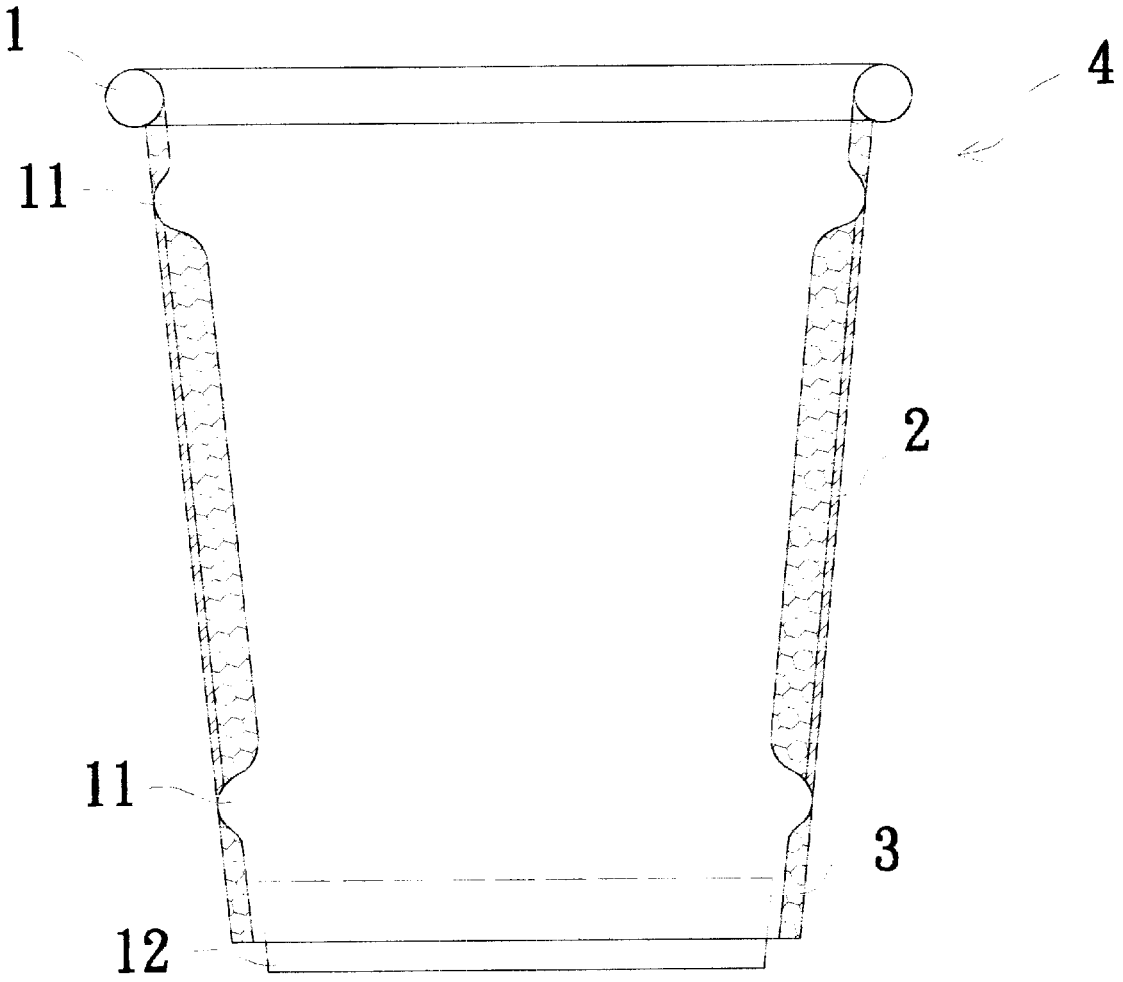
FIG. 3 shows an exploded view of the present invention.

It is therefore the primary object of present invention to provide the above melioration of insulating paper container. Referring to FIGS. 1 and 2, the present invention of insulating paper container includes a pre-sized inner cup (1) and an outer cup(3). The outer cup is made from paper material wherein one side is decorated with printing or with color, logo or picture, and the other side is coated evenly with material comprising chemical laminating agent and foaming agent (2) such as polyethylene. The material paper is then rolled into a hollow cup shape narrowing down from the top to bottom (as shown in FIG. 1).

At the same time, another paper material is rolled and processed to a cup shape with base (12) with two additional bulge rings (11) around the top and bottom end of the cup, in order to form a cup shape which narrows down from the top to bottom with double bulge rings (11) around the surface of inner cup(1). Inner cup (1) and outer cup (3) are assembled to form a whole unit by placing the inner cup into the outer cup. The two cups will be stable and will stick together by the two bulge rings. The cup unit (4) is formed at this stage.

The cup unit (4) is then heated to a temperature of 80 C.~200 C. for approximately 0.5~30 second (the heating time varies according to the thickness of the paper material used). The heat will evaporate the wetness of the paper cup, and allow chemical laminating agent and foaming agent (2) to form a insulating layer, and complete the formation of the cup or container of the present invention.

What is claimed is:

1. A container which comprises an inner paper cup inserted into an outer paper cup; said inner cup including a base and two spaced apart bulge rings around said inner cup wherein said bulge rings stabilize said inner cup in said outer cup and define a volume between said inner cup and said outer cup; said volume containing foam insulation produced by foaming a foamable coating on an inner side of said outer cup wherein said foamable coating is foamed by the foaming action of a foaming agent in said coating; said foamable coating including a chemical laminating agent whereby said foam insulation in said volume joins said inner cup to said outer cup.

2. The container of claim 1 wherein said foamable coating comprises polyethylene.

3. A container which comprises an inner paper cup inserted into an outer paper cup; said inner paper cup and said outer paper cup being spaced apart from one another to thereby define a volume between said inner cup and said outer cup; said volume containing foam insulation produced by foaming a foamable coating on an inner side of said outer cup wherein said foamable coating is formed by the foaming action of a foaming agent in said coating; said foamable coating including a chemical laminating agent whereby said foam insulation in said volume joins said inner cup to said outer cup.

4. The container of claim 3 wherein said foamable coating comprises polyethylene.

* * * * *